US005563686A

United States Patent [19]

Beaufort et al.

[11] Patent Number: 5,563,686

[45] Date of Patent: Oct. 8, 1996

[54] INPUT PAPER SENSOR FOR SINGLE SHEET PAPER PROCESSING EQUIPMENT

[75] Inventors: Richard F. Beaufort, Boise; Robin P. Yergensen, Meridian, both of Id.

[73] Assignee: Hewlett-Packard Company, Palo Alto, Calif.

[21] Appl. No.: 381,382

[22] Filed: Jan. 31, 1995

[51] Int. Cl.[6] ..... G03G 21/00

[52] U.S. Cl. ..... 355/206; 271/258.03; 355/316

[58] Field of Search ..... 355/205, 206, 355/316; 271/3.15–3.17, 4.02, 4.03, 10.02–10.03, 258.03, 265.01, 258.01

[56] References Cited

U.S. PATENT DOCUMENTS

| | | | |
|---|---|---|---|
| 3,970,384 | 7/1976 | Yamamoto et al. | 355/206 |
| 4,937,622 | 6/1990 | Makiura | 355/206 |
| 5,262,637 | 11/1993 | Cumberledge et al. | 250/223 |
| 5,262,823 | 11/1993 | Nakajima et al. | 355/205 |
| 5,365,322 | 11/1994 | Hamada et al. | 355/316 |

FOREIGN PATENT DOCUMENTS

| | | |
|---|---|---|
| 4-338064 | 11/1992 | Japan . |

*Primary Examiner*—Nestor R. Ramirez

[57] ABSTRACT

Paper processing equipment such as a laser printer uses a plurality of sensors to detect the presence of paper in the paper path of the equipment. In order to determine the nature of malfunctions indicated by presence or absence of paper at the sensors, data from the sensors is coordinated with information concerning the timing of the data. In one embodiment, a single data signal is used to provide information that a paper supply hopper is empty and that paper is present at an output of a paper sheet pick mechanism. Advantages include simpler operation and the provision of discrete display indicia for different types of malfunctions and paper out conditions.

12 Claims, 4 Drawing Sheets

INPUT PAPER SENSOR FOR SINGLE SHEET PAPER PROCESSING EQUIPMENT

CROSS-REFERENCE TO RELATED APPLICATION

This application shares common subject matter with U.S. patent application 08/381,371, for Selective Ejection of Sensed Paper Jams in Single Sheet Paper Processing Equipment, commonly assigned, and filed on an even date herewith. The disclosure material of said application is incorporated by reference.

FIELD OF THE INVENTION

This invention relates to electrophotographic printing, such as used on laser printers. More particularly, the invention relates to sensing the proper and improper movement of paper during the operation of electrophotographic equipment or other paper processing equipment.

BACKGROUND OF THE INVENTION

This invention relates to paper processing wherein individual sheets are separated from a stack of sheets and further processed. This type of operation is performed by electrophotographic equipment, as well as a myriad of other paper processing equipment. The processing includes manipulating or handling the paper by the equipment in order to move the paper along a paper path. This invention can be used in conjunction with a wide variety of paper processing equipment, but was developed for use with electrophotographic equipment such as laser printers. The invention will be described in its application to electrophotography, it being understood that it also has applicability to other types of paper processing equipment.

Regardless of the particular configuration of the paper processing equipment, many have in common a paper pick, followed by a primary series of paper processing operations. The primary series of paper processing operations in the electrophotographic equipment, including the laser printer of the preferred embodiment is the developer and fuser stations. This includes the laser printer of the preferred embodiment of this invention.

In electrophotographic printing, individual sheets of paper are taken from a stack of paper in a paper supply and an image, corresponding to a pattern of electrostatic charges, is applied to the paper. The removal of an individual sheet of paper is referred to as a "pick."

In the Assignee's Laser Jet printers, such as the Assignee's Laser Jet II-P™ printer, a pick is accomplished by a roller having an asymmetric profile, called a "D roller," rotating past a fixed pad. The D roller has a higher coefficient of friction with paper than the fixed pad. The fixed pad is spring loaded against the D roller so that only a single sheet of paper normally is moved by the rotation of the D roller. This generally accomplishes the desired pick of a single sheet of paper which is thereby fed to the electrophotographic imager, and subsequently ejected as a printed page.

If this does not happen (i.e., a single sheet is not picked and successfully ejected after passing the imager), then sensors are used to detect a paper jam or related malfunction. The sensors generally consist of paper feed sensors, located before the imager, and forward sensors, located at the output of the imager, such as at the fuser station. This invention relates to an arrangement for paper feed sensors. The paper sensors typically sense the presence of paper in the paper supply and the presence of paper at the output of the D roller, and passage of the leading edge of the picked sheet. It should be noted that the forward sensors are located downstream of the paper feed sensors, and so are not forward of the paper feed sensors despite the terminology.

In the event of a sensed malfunction, a display on the printer indicates that the malfunction has occurred. The usual procedure requires the operator to investigate and remedy the malfunction, and press a "continue" or "operational reset" button. If the malfunction is a true paper jam, the equipment is partially opened, the wrinkled paper is removed from the paper path. Thereafter, the equipment is closed and the normal operation is continued upon pressing the button. On the other hand, the malfunction may be an empty paper supply. This of course does not require that paper be removed, but merely that the paper supply be replenished.

The reference to a paper out condition as a malfunction is not merely a problem of semantics, since the user may find it unnatural to see the equipment react to a paper out condition in the manner of a paper jam. In addition to the paper out condition being a function of the normal operation of the equipment, there are times that the paper out condition is even intentional. It is therefore important that the equipment be able to distinguish between a paper out condition and other paper supply malfunctions.

The detection of different paper positions can be accomplished by providing discrete sensors for each position. Under that arrangement, detection of presence of paper in the paper supply, the presence of paper at the output of the D roller, and passage of the leading edge of the picked sheet can be accomplished by at least three sensors. This enables the equipment to react to different types of malfunctions according to the malfunction. As an example, it is possible to discretely indicate a paper out condition, and even to automatically restart the equipment when the paper supply has been replenished.

Detection of different paper positions can also be accomplished without a sensor for detecting paper in the paper supply. In that case, the initial reaction of the printer to a print command is to initiate a pick and to later declare a paper jam.

For the purposes of detection of paper feed malfunctions, it is possible to ignore the forward sensors. Thus, malfunctions related to the fuser station are treated separately from malfunctions of the paper feed mechanism.

It is also desirable to reduce the number of sensing elements in order to reduce cost and complexity of the equipment. Thus, if a single switch or photosensor is used in place of two or three switches, the costs of switches and the chances of switch failure are reduced. The use of mechanical switches instead of photosensors has the advantage of lower cost, but also requires that force applied to operate the switches be present. As an alternative, photosensors are placed in the path of flags which are themselves mechanical arm and lever arrangements. This reduces the force applied to that necessary to cause the flag to move.

It is therefore desirable to provide an arrangement wherein different malfunctions are sensed and distinguished with a minimum of sensor apparatus. It is further desired to use a single photodetector for multiple sensing functions, with a minimum of mechanical complexity. It is further desired to reduce the number of sensors without substantially reducing the conditions sensed. In doing so, it is desired to utilize information which is obtained from other known factors.

SUMMARY OF THE INVENTION

According to the invention, the number of sensors on paper processing equipment, such as a laser printer, is reduced by the use of a single sensor to detect paper at multiple locations. The arms have flags which selectively interrupt a light path of a photosensor, thereby providing logical information regarding the presence of paper at different locations at different times. This information is combined with timing information and with information from other sensors, such as sensors located at an output station of the equipment.

In a preferred embodiment of the invention, the sensing of the paper is accomplished by multiple arms which have flags. The flags on plural arms interrupt the light path of one photosensor, thereby allowing a single photosensor to be used to sense multiple conditions. This ability is enhanced by combining the logic output of the photosensor with timing information and with information from other sensors. This enables the equipment to distinguish between different sensed malfunctions.

In one aspect of the invention, a single photosensor is used to sense the presence of paper in the paper supply and the presence of paper at the output of the D roller, and passage of the leading edge of the picked sheet. This may be accomplished by the use of plural mechanical arms which interrupt a light path in the photosensor.

In the preferred embodiment, a plurality of arms extend into sensed positions along the paper path and the arms have extensions or flags which are able to interrupt light passing through the photosensor. The interruption of the photosensor is interpreted in accordance with an anticipated timing of other functions of the paper processing equipment. These functions include the output of the sensors located at the output station of the equipment, and the timing of a cycle of the equipment, along with external inputs such as paper sheet size.

The preferred technique for resolving the timing information is by the use of a clock timer. Since the mechanical movement of the paper processing equipment also provides timing information, it is alternatively possible to time the information from the sensors by the use of sensed position of the paper processing mechanism.

According to a further aspect of the invention, the single input sensor is used in association with other data in order to provide paper processing equipment with an ability to separately indicate different types of malfunctions, such as a paper out condition.

While paper and paper processing is described herein, it is understood that the invention is useful with other types of sheet media and sheet media processing.

DETAILED DESCRIPTION OF THE PREFERRED EMBODIMENTS

Figure 1:
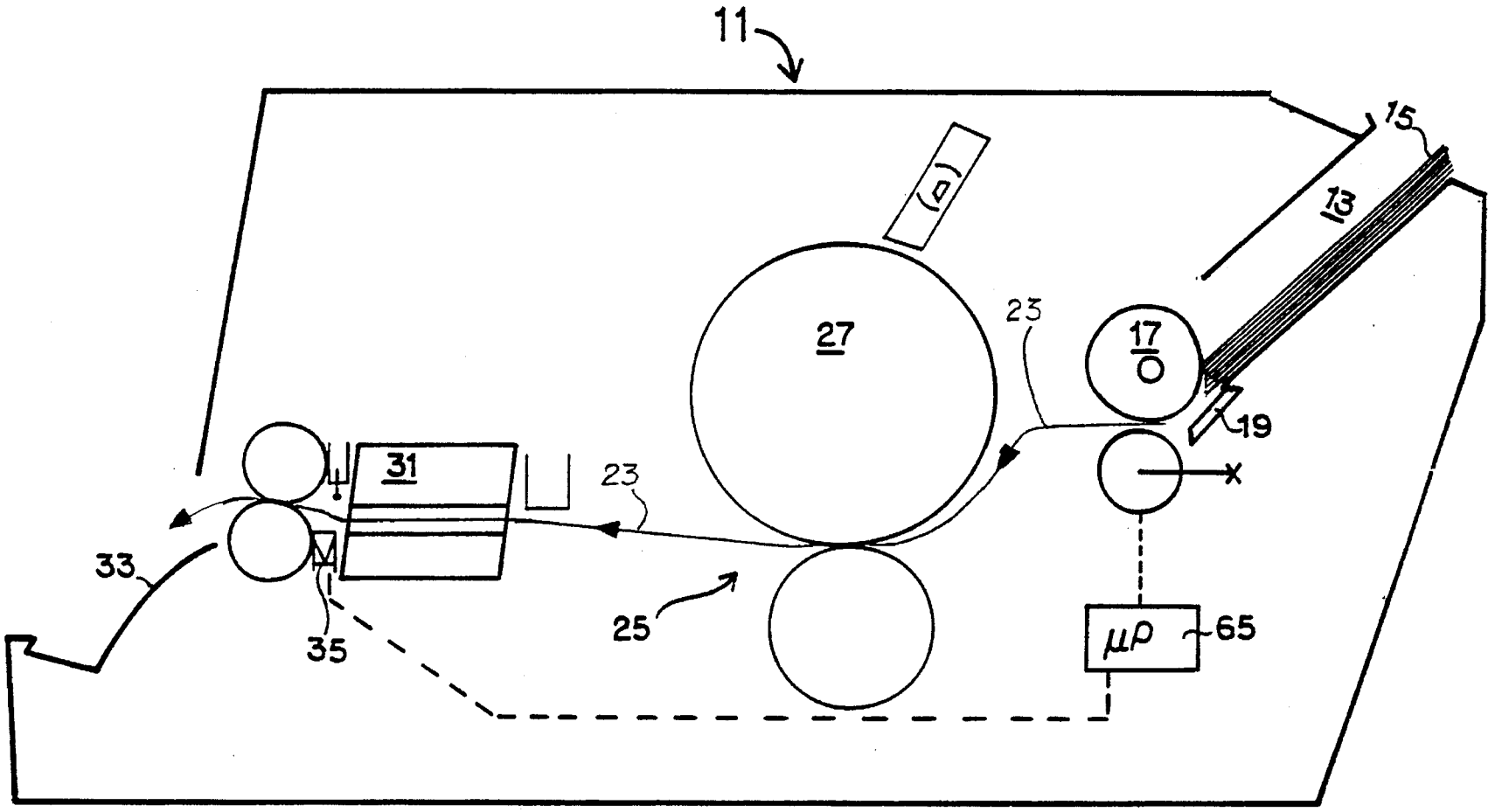
FIG. 1 shows a cross-sectional view of a paper path, including a paper supply station used in electrophotographic printing.

Referring to FIG. 1, a laser printer 11 is provided with a paper supply hopper 13, where one or more sheets of paper are retained as a stack of paper 15. While a laser printer 11 is shown, the invention may be implemented in the form of other paper processing equipment such as other types of electrophotographic printers, jet printers, and folding and collating machines. An eccentric roller 17, known as a D roller, is used to remove individual sheets of paper from the stack 15. The D roller 17 is aligned against a fixed pad, in the form of a stationary plate 19. The D roller 17 also has a higher coefficient of friction with respect to paper than the stationary plate 19, so that relative movement of the D roller 17 against the stationary plate 19 with paper between the parts (17 and 19) will result in the paper slipping past the stationary plate 19 and moving with the D roller 17. The stationary plate 19 is spring loaded against the D roller 17 and the coefficients of friction are such that only a single sheet of paper normally is moved by the rotation of the D roller 17, and is thereby moved past the stationary plate 19.

The removal of an individual sheet from the stack 15 is known as a pick, and is the technique which is preferably used to remove individual sheets of paper for purposes of further paper processing. It is understood that other techniques for effecting a pick are also consistent with this invention. In the laser printer application, the further paper processing consists of passing the sheet of paper along a paper path 23 to a developer station 25, which includes an optical photoreceptor (OPR) 27. In the preferred embodiment, the OPR 27 is a cylindrical drum (shown), although it is contemplated that other configurations for the OPR 27 are possible. The sheet is then further processed, usually passing a fuser station 31 to a discharge tray 33. Additional paper processing may be performed, such as providing a dryer station (used in liquid imaging systems, not shown) and a discharge handler such as a paper collator (not shown).

Regardless of the particular configuration of the paper processing equipment, many have in common a paper pick, followed by a primary series of paper processing operations. The primary series of paper processing operations in the laser printer of the preferred embodiment is the developer and fuser stations 25, 31. If the single sheet of paper is picked, followed by a discharge from the fuser station 31, a successful cycle can generally be assumed, at least as far as the primary paper processing operations. On the other hand, if the paper does not quite make it out of the primary series of paper processing operations, than a malfunction may be assumed. The sensing of paper discharge from the fuser station 31 is accomplished by forward paper sensors, represented by sensor 35.

There are various configurations for the forward paper sensors (sensor 35), depending on the particular configuration of the paper processing equipment. In the preferred embodiment of this invention, sensor 35 senses that paper is discharged from the fuser station 31 in order to coordinate this information with the pick of the sheet. It is alternatively possible to use a sensor which may be located on the paper path before the fuser station 31, or at any other location. For the purposes of this invention, any sensing of paper having proceeded beyond the sensing of a paper pick can be used.

Figure 2:
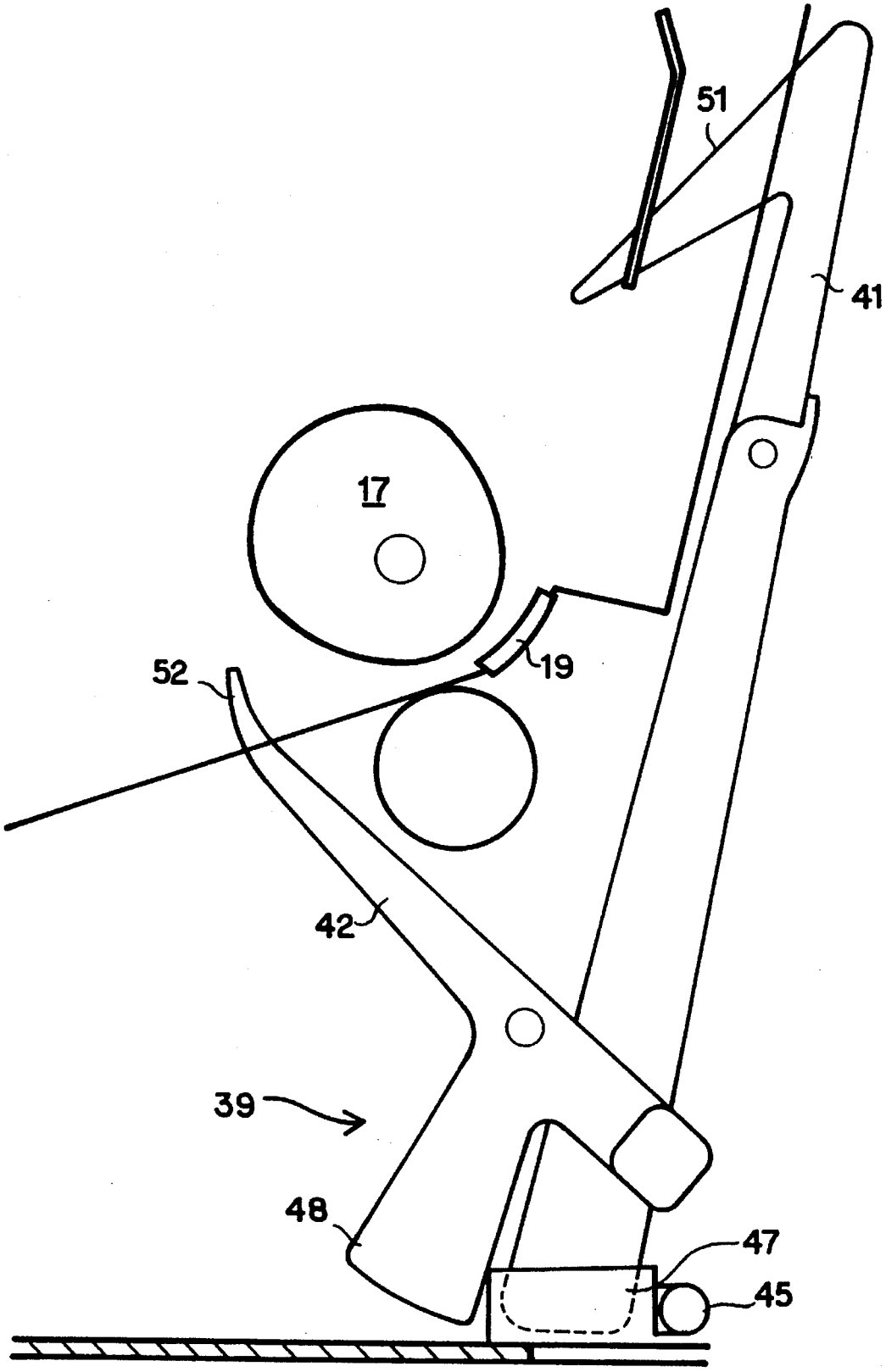
FIG. 2 shows a cross-sectional view of a paper supply station of FIG. 1, in which plural sensor flags trip a single photosensor according to a preferred embodiment of the present invention.

Referring to FIG. 2 as well as FIG. 1, a sensor mechanism 39 for the paper supply preferably consists of two levers 41, 42 which extend into the paper path as feeler arms. In the preferred embodiment of this invention, the two levers 41, 42 selectively block a single photosensor 45. The photosensor provides a sensed logic state, which indicates a blocked or non-blocked optical path to the photosensor 45 from an optical source (shown as part of the photosensor 45). The blocking of the photosensor 45 is accomplished by tabs 47, 48, which extend respectively from the levers 41, 42. The portions of the levers 41,42 which extend across the paper path are called flags 51, 52. While the preferred configuration is the use of a single photosensor 45, it is anticipated that the production configuration of the sensor mechanism 39 will use plural photosensors instead of the single photosensor 45.

Ambiguities in sensing the paper at different locations are avoided by sensing a pick jam and comparing the pick jam with the time delay of reaching the fuser sensor.

It is therefore desired to have the printer 11 respond to the paper out condition differently by either providing a completely distinctive display of the condition and/or by providing an indication of the paper out condition at a different time with respect to an operational cycle of the printer 11. In order to distinguish the paper out condition from a paper jam detected by the operation of lever 42, the timing of the operation of the printer 11 is used. If the indication of a malfunction from photosensor 45 is the result of a paper out condition, the sheet of paper will be detected by a forward sensor 35 at an appropriate time after the beginning of the sensing of the sheet by lever 42. If the sheet is detected at the appropriate time by the forward sensor 35, then the malfunction indication will be of a paper out condition.

On the other hand, if the malfunction is either a paper jam as sensed by the operation of lever 42 or a combination of such a paper jam and a paper out condition, the indication from photosensor 45 would have the similar timing to that of a paper out condition alone. In that case, the sheet of paper will not be detected by one or more of the forward sensors, represented by sensor 35 at the appropriate time. This would be indicated as a paper jam. If the common photosensor 45 is used to indicate a paper out condition, then the separate paper out condition would not be indicated, until the paper jam is cleared.

Thus, the timing sequence, whether mechanical (by movement of the paper processing equipment) or by timing (anticipating the timing of the movement of the paper processing equipment) is used to resolve ambiguities which would occur, should the static state of the sensors 35, 41, 42 be viewed without the timing of the signals from the sensors 35, 41, 42. Thus the timing sequence is used to resolve static ambiguities of the signals from sensors 35, 45, even though signals from the sensors may have different meanings at different times.

The coordination of information from photosensor 45 and forward sensor 35 is accomplished by switching. The switching for the coordination of information from photosensor 45 and forward sensor 35 may be accomplished by any of a number of means known to those skilled in the art of signal processing. Since it is anticipated that a microprocessor 65 will be provided for the purposes of controlling the printer 11, the microprocessor 65 is shown as controlling the information provided by error displays. While a microprocessor is shown, any type of convenient switching mechanism may be used to provide outputs in response to signals from the sensors 35, 45.

The switching may also be provided through mechanical switching, and in the most basic sense, the switching may be accomplished manually, although this is considered to be impractical because of the limitations of human operators and because the purpose of the invention is to provide the information from the output of the switching without further human intervention.

The event that the paper supply hopper 13 being empty at the beginning of the cycle would not create an ambiguity with sensing of the leading edge of paper, since the paper out condition would be used to prevent active cycling of the printer 11.

In order to distinguish between a continuing paper jam after attempted clearing of the jam, and a paper out condition, it is possible to provide a mechanical or other mechanism which causes the paper out lever 41 to momentarily interrupt its blocking of the photosensor 45. In this manner, if the single photosensor 45 is used, the success of unblocking of the paper path at the leading edge sensor lever 42 can be determined.

The specific method of determining the appropriate time that the sheet should be detected by the forward sensor may be by timing, by mechanical movement of the mechanism of the printer 11 or any other convenient function or combination of functions. In the preferred embodiment, it is anticipated that a clock timer circuit will be used, wherein timing may be selected based on initiation of the pick or any other appropriate start signal. Machine timing and control techniques are well-known in the art and the specific technique would be determined in accordance with the types of signals already available when the printer 11 is designed for manufacture.

Figure 3A:
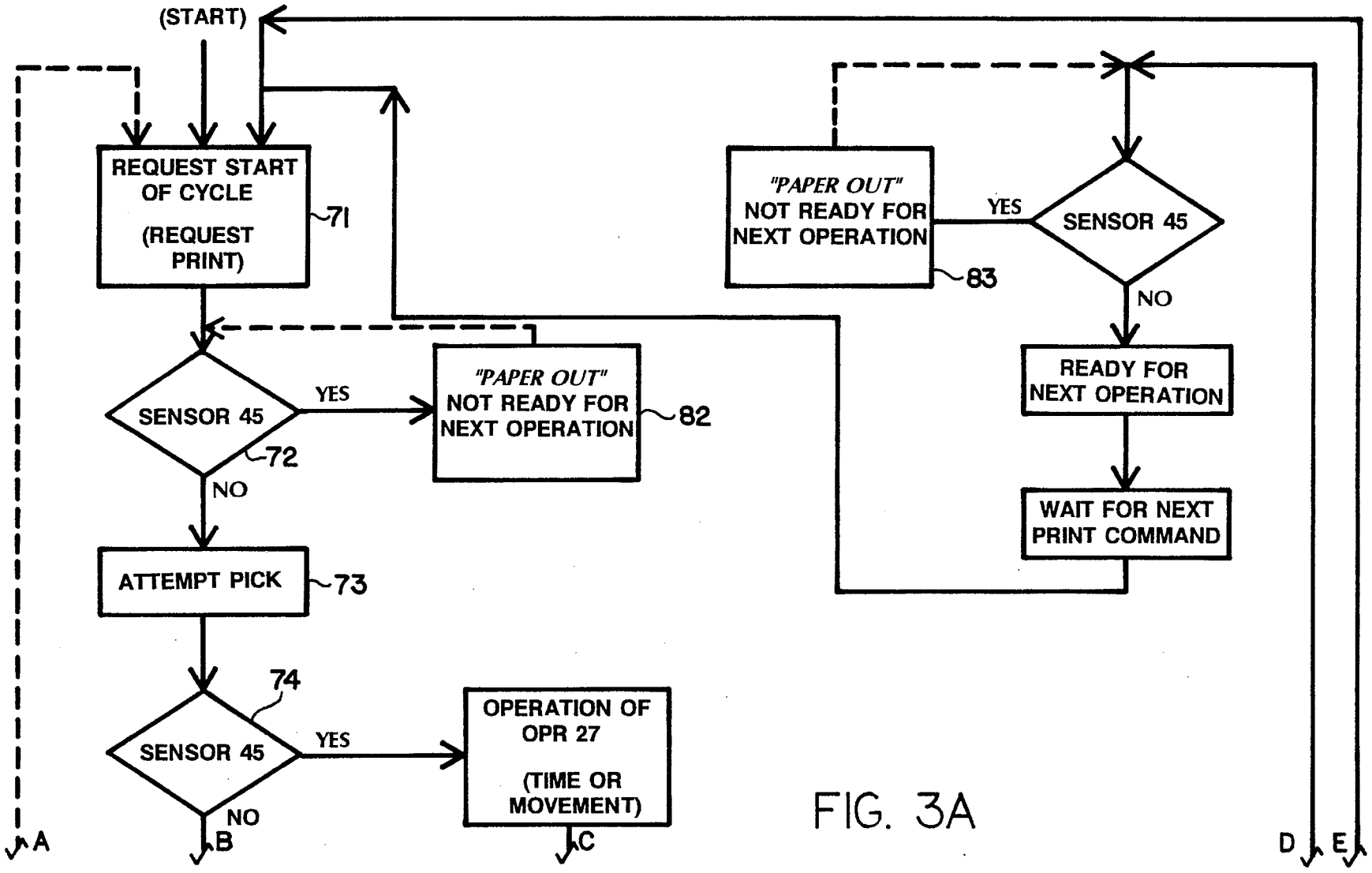
FIGS. 3A and 3B show a sample simplified logic flow pattern used with the sensor of FIG. 1.
Figure 3B:
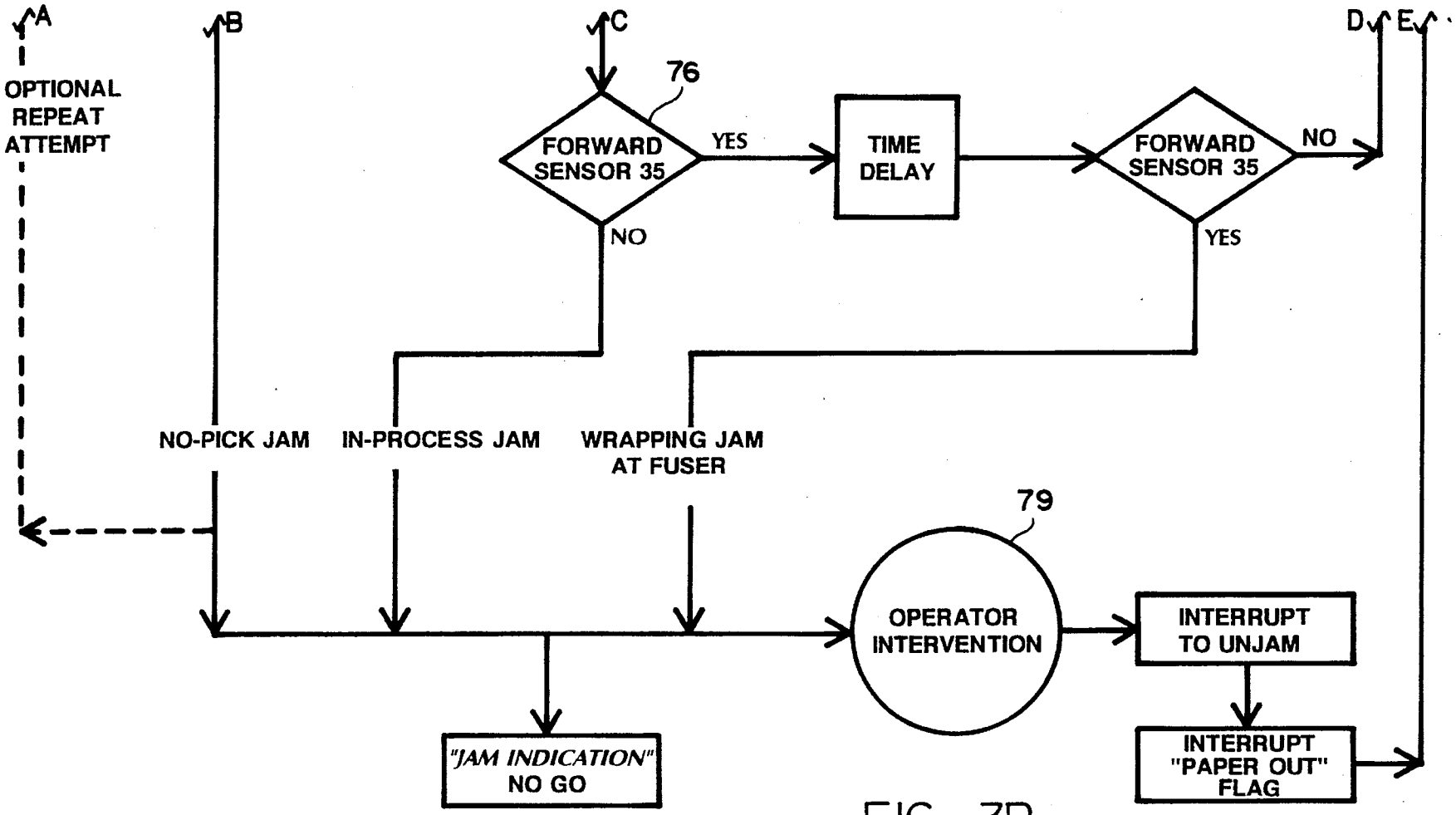

Referring to FIGS. 3A and 3B, the logic of misfeed sensing and indications is in response to receipt of a request for print command, indicated by box 71. This is followed by sensing activation of the photosensor 45, as indicated by box 72. If there is no indication, then a pick is attempted, indicated by box 73. The printer 11 may make another pick attempt or immediately provide a jam indication.

In reading the flow chart of FIGS. 3, one should note that sensor 45 provides a sensed logic level, shown as "yes," to indicate absence of paper at the supply hopper 13 as well as presence of paper at the output of the D roller 17.

The lack of a predetermined sensed logic condition (light blocked in the preferred embodiment) after an anticipated time or physical movement of the D roller 17 indicates that no successful pick has occurred, indicated by box 74, resulting in a jam indication. The printer continues operation, after which time an indication from forward sensor 35 is anticipated, as indicated by box 76. The operator may attempt to correct the jam (box 79), after which another print attempt may be made.

If a "paper out" condition is present after a print operation, the printer 11 may wait for paper to be inserted into the hopper 13, as indicated by boxes 82 and 83.

The above is a description of the logic of the paper supply sensing. Naturally other sensing logic operations may be incorporated into the printer 11.

As mentioned, the presence of the predetermined sensed logic state of the photosensor 45 indicates either absence of paper in the supply hopper 13 or paper present at the output of the D roller 17. The subsequent sensing at the forward sensor 35 indicates that the paper has successfully cleared the D roller 17. If the signal persists in the predetermined sensed logic state, then a paper out condition is reported. The paper out condition can be reported in a manner which distinguishes the paper out condition from other malfunctions.

This sensing system now has the ability to coordinate the sensing of various functions so as to determine the state of paper in the paper supply hopper 13. This allows the printer 11 to accept a paper out condition, followed by the paper hopper 13 being replenished. Since the sensing is coordinated, it is possible to permit the printer 11 to perform subsequent print operations after the paper hopper 13 has been replenished, without further operator intervention.

There are various ways of accomplishing the various functions described. As an example, it is possible to use the inventive sensor system in paper processing equipment which receives continuous form paper. In such an arrangement, a different type of paper feed arrangement may be substituted for the D roller 17, but the paper supply sensing and the occurrence of a sheet at the position of the leading edge sensor 42 would still be used to provide information regarding the movement of paper across the paper path. It is also possible to provide different combinations of sensors, such as multiple sensors, power consumption sensors, as well as mechanical movement devices and timers. It is therefore anticipated that the invention should be limited in scope only by the claims.

What is claimed is:

1. Paper processing apparatus comprising:

a. a sheet media supply hopper;

b. a sensor for determining the presence of sheet media in the sheet media supply hopper;

c. a pick mechanism for selecting a sheet of sheet media from the sheet media supply hopper and providing said sheet at an output of the pick mechanism;

d. a pick sensor for determining the presence of sheet media at an output of the pick mechanism, said pick sensor and the sensor for determining the presence of sheet media in the sheet media supply hopper generating a common data signal;

e. a forward position sensor to detect the presence of said sheet of sheet media after a primary series of sheet media handling operations;

f. switching means, responding in a different manner in accordance with a sequence of detection of the presence of sheet media at said sensors; and a mechanism to momentarily interrupt a signal from the sensor for determining the presence of sheet media at the sheet media supply hopper during an attempt by an operator to clear a paper jam, thereby resolving an ambiguity between detection of said signal from the sensor for determining the presence of sheet media at the sheet media supply hopper and a continued paper jam.

2. Paper processing apparatus as described in claim 1, further comprising:

said data signal provided as the output of a photosensor, the photosensor controlled by the movement of separate feeler arms for determining the presence of sheet media in the sheet media supply hopper and determining the presence of sheet media at an output of the pick mechanism.

3. Paper processing apparatus as described in claim 2, further comprising:

a. the feeler arm for determining the presence of sheet media in the sheet media supply hopper generating said output from the photosensor in a first logic sense in response to detection of presence of sheet media in the sheet media hopper and generating said output from the photosensor in a second logic sense in response to not detecting presence of sheet media in the sheet media hopper;

b. the feeler arm for determining the presence of sheet media at the output of the pick mechanism generating said output from the photosensor in said second logic sense in response to detection of sheet media at the output of the pick mechanism and generating said output from the photosensor in said first logic sense in response to not detecting presence of sheet media at the output of the pick mechanism; and c. the feeler arm for determining the presence of sheet media in the sheet media supply hopper and the feeler arm for determining the presence of sheet media at the output of the pick operation providing a logical OR function with said logic signal of said second logic sense.

4. Paper processing apparatus as described in claim 3, wherein a timing of detection by said sensors resolves ambiguities between the detection of a sheet media out condition and at least one other detected condition.

5. Paper processing apparatus as described in claim 1, wherein said switching means uses said sequence of detection of the presence of sheet media at said sensors to discriminate between said sheet media out malfunction and said other types of malfunctions, regardless of a static ambiguity of said sensors.

6. Paper processing apparatus as described in claim 1, further comprising:

a. said data signal provided as the output of a common switching device, the common switching device controlled by the movement of separate feeler arms for determining the presence of sheet media in the sheet media supply hopper and determining the presence of sheet media at an output of the pick mechanism;

b. the feeler arm for determining the presence of sheet media in the sheet media supply hopper generating said output from the common switching device in a first logic sense in response to detection of sheet media in the sheet media hopper and generating said output from the common switching device in a second logic sense in response to not detecting presence of sheet media in the sheet media hopper;

c. the feeler arm for determining the presence of sheet media at the output of the pick mechanism generating said output from the common switching device in said second logic sense in response to detection of presence of sheet media at the output of the pick mechanism and generating said output from the common switching device in said first logic sense in response to not detecting presence of sheet media at the output of the pick mechanism; and d. the feeler arm for determining the presence of sheet media in the sheet media supply hopper and the feeler arm for determining the presence of sheet media at the output of the pick operation providing a logical OR function with said logic signal of said second logic sense.

7. Paper processing apparatus as described in claim 1, further comprising:

a. said data signal provided as the output of a common switching device, the common switching device controlled by the movement of separate feeler arms for determining the presence of sheet media in the sheet media supply hopper and determining the presence of sheet media at an output of the pick mechanism;

b. the feeler arm for determining the presence of sheet media in the sheet media supply hopper generating said output from the common switching device in a first logic sense in response to detection of presence of sheet media in the sheet media hopper and generating said output from the common switching device in a second logic sense in response to not detecting presence of sheet media in the sheet media hopper;

c. the feeler arm for determining the presence of sheet media at the output of the pick mechanism generating said output from the common switching device in said second logic sense in response to detection of presence of sheet media at the output of the pick mechanism and generating said output from the common switching device in said first logic sense in response to not detecting presence of sheet media at the output of the pick mechanism;

d. the feeler arm for determining the presence of sheet media in the sheet media supply hopper and the feeler arm for determining the presence of sheet media at the output of the pick operation providing a logical OR function with said logic signal of said second logic sense; and e. a mechanism for momentarily forcing the output of the common switching device to go to the first logic sense, at least in the case of generation of output by the feeler arm for determining the presence of sheet media in the sheet media supply hopper, so as to interrupt the signal from the sensor for determining the presence of sheet media at the sheet media supply hopper during said attempt by an operator to clear a paper jam.

8. Paper processing apparatus as described in claim 1, further comprising:

a. said sensor located so as to detect said sheet after said sheet media processing operations have commenced; and b. a display, responsive to the switching means, for providing an indication of malfunctions in a sheet media path of the paper processing apparatus, whereby sheet media out conditions generate a separate malfunction indication from other types of malfunctions in the sheet media path in the absence of detection of said other types of malfunctions, thereby allowing an operator to respond to said sheet media out conditions differently from said other types of malfunctions.

9. Paper processing apparatus comprising:

a. a supply sheet media store;

b. a mechanism for effecting a pick operation by withdrawing a sheet of sheet media from the sheet media store for said further sheet media processing;

c. an input sensor for detecting a sheet media out condition in the sheet media store;

d. a pick sensor for detecting the presence of sheet media at the mechanism for effecting a pick operation, said pick sensor and the input sensor generating a common data signal;

e. a forward sensor for detecting the presence of sheet media after said further sheet media processing, provided that said sheet of sheet media had successfully been processed by said paper processing apparatus up to that point;

f. a clock; and g. an indicator, whereby:

when the input sensor provides an indication of a sheet media out condition at the beginning of a cycle of the paper processing apparatus, the indicator provides an indication of a sheet media out condition;

when the pick sensor fails to detect the presence of sheet media at a time of the cycle corresponding to an anticipated presence of sheet media, the indicator provides an indication distinct from that of the sheet media out indication; and when the forward sensor fails to detect the presence of sheet media at a time of the cycle corresponding to said anticipated presence of sheet media, the indicator provides an indication distinct from that of the sheet media out indication, wherein the timing of detection by said sensors resolves ambiguities between the detection of a sheet media out condition and at least one other detected condition.

10. Paper processing apparatus as described in claim 9, further comprising:

a. the sensor for detecting a sheet media out condition providing a signal in a first logic sense in response to detection of presence of sheet media and providing a signal in a second logic sense in response to not detecting presence of sheet media in the sheet media hopper;

b. the sensor for providing an indication of sheet media at the mechanism for effecting a pick operation providing a signal in said second logic sense in response to detection of sheet media at the pick mechanism and providing a signal in said first logic sense in response to not detecting presence of sheet media at the pick mechanism; and c. the sensor for detecting the presence of sheet media in the sheet media supply hopper and the sensor for detecting the presence of sheet media at the mechanism for effecting a pick operation providing a logical OR function with said logic signal of said second logic sense.

11. Paper processing apparatus as described in claim 9, further comprising:

a. said data signal provided as the output of a common switching device, the common switching device controlled by the movement of separate feeler arms for determining the presence of sheet media in the sheet media supply hopper and determining the presence of sheet media at an output of the pick mechanism;

b. the feeler arm for determining the presence of sheet media in the sheet media supply hopper generating said output from the common switching device in a first logic sense in response to detection of presence of sheet media in the sheet media hopper and generating said output from the common switching device in a second logic sense in response to not detecting presence of sheet media in the sheet media hopper;

c. the feeler arm for determining the presence of sheet media at the output of the pick mechanism generating said output from the common switching device in said second logic sense in response to detection of presence of sheet media at the output of the pick mechanism and generating said output from the common switching device in said first logic sense in response to not detecting presence of sheet media at the output of the pick mechanism;

d. the feeler arm for determining the presence of sheet media in the sheet media supply hopper and the feeler arm for determining the presence of sheet media at the output of the pick operation providing a logical OR function with said logic signal of said second logic sense; and e. a mechanism for momentarily forcing the output of the common switching device to go to the first logic sense, at least in response to generation of Said output by the feeler arm for determining the presence of sheet media in the sheet media supply hopper, so as to interrupt the signal from the sensor for determining the presence of sheet media at the sheet media supply hopper during an attempt by an operator to clear a paper jam, the interruption in the signal thereby resolving an ambiguity between detection of said signal from the sensor for determining the presence of sheet media at the sheet media supply hopper and a continued paper jam.

12. Method of processing sheet media, comprising:

a. providing a signal to indicate detection of presence of sheet media in a sheet media supply hopper;

b. selecting a sheet of sheet media from a sheet media supply hopper, and providing said sheet at a first output;

c. further providing said signal to indicate detection of presence of sheet media at the first output;

d. providing a signal to indicate detection of presence of said sheet of sheet media after said primary series of sheet media handling operations;

e. responding to said signals in a different manner in accordance with a sequence of detection of the presence of sheet media, whereby sheet media out conditions generate a separate malfunction indication from other types of malfunctions in the sheet media path in the absence of detection of said other types of malfunctions; and f. momentarily interrupting said signal provided to indicate presence of sheet media at the sheet media supply hopper during an attempt by an operator to clear a paper jam, thereby resolving an ambiguity between detection of said signal from the sensor for determining the presence of sheet media at the sheet media supply hopper and a continued paper jam.

* * * * *